United States Patent [19]

Kau et al.

[11] Patent Number: 4,739,362

[45] Date of Patent: Apr. 19, 1988

[54] TRANSFER SYSTEM

[75] Inventors: Karl M. Kau, Rochester; Donald R. Winters, Jr., Alfred Station, both of N.Y.

[73] Assignee: Xerox Corporation, Stamford, Conn.

[21] Appl. No.: 928,449

[22] Filed: Nov. 10, 1986

[51] Int. Cl.[4] ..... G03G 15/14

[52] U.S. Cl. ..... 355/3 TR; 355/14 TR; 355/14 SH

[58] Field of Search ..... 355/3 TR, 14 TR, 14 SH

[56] References Cited

U.S. PATENT DOCUMENTS

| | | | |
|---|---|---|---|
| 3,516,657 | 6/1970 | Knudsen | 271/68 |
| 3,820,889 | 6/1974 | Nitanda et al. | 355/3 R |
| 3,984,183 | 10/1976 | Maksymiak | 355/16 |
| 4,204,672 | 5/1980 | Grivet | 271/188 |
| 4,350,332 | 9/1982 | Knight | 271/188 |
| 4,478,506 | 10/1984 | Miyoshi et al. | 355/3 TR X |

FOREIGN PATENT DOCUMENTS

| | | |
|---|---|---|
| 49-128320 | 10/1974 | Japan . |
| 49-131266 | 11/1974 | Japan . |

*Primary Examiner*—Patrick R. Salce
*Assistant Examiner*—Emanuel Todd Voeltz
*Attorney, Agent, or Firm*—Mark Costello

[57] ABSTRACT

An improved transfer station baffle arrangement provided with first and second baffles, the first baffle provided with a curved sheet supporting surface imparting a bow to sheets passing thereby, the second baffle normally biasing the sheets against the first baffle, and biasable out of position with respect thereto. A flexible lip may be provided on the second baffle to absorb spring force energy in sheets passing through the baffle arrangement as the direction of sheet travel is changed.

12 Claims, 2 Drawing Sheets

TRANSFER SYSTEM

BACKGROUND OF THE INVENTION

The present invention relates to xerographic reproduction machines, and more particularly to improving the transfer of an image from a photoreceptor to a transfer member such as a sheet of paper.

In electrophotographic reproduction, a photoreceptor comprising a layer of photosensitive insulating material affixed to a conductive substrate is used to support electrostatic latent images. The surface of the photosensitive material is electrostatically charged, and exposed to a light pattern of an image to be reproduced to selectively discharge the surface in accordance with the image. The undischarged areas of the surface form an electrostatic charge pattern (an electrostatic latent image) conforming to the original pattern. The latent image is then developed by contacting it with a finely divided electrostatically attractable powder referred to as "toner". Toner is held on the image areas by the electrostatic charge on the surface. Thus, a toner image is produced in conformity with a light image of the copy being reproduced. The toner image is then transferred to a suitable substrate (e.g. paper), and the image is affixed thereto to form a permanent record of the original document. The process is well known, and is useful for light lens copying from an original, and printing applications from electronically generated or stored originals.

During the toner transfer, a substrate or transfer member such as a sheet of paper (hereinafter sheet or copy sheet) is caused to move in synchronized contact with the photosensitive surface during the transfer operation, and an electrical potential opposite from the polarity of the toner is applied to the side of the sheet remote from the photosensitive surface to electrostatically attract the toner image from the photoreceptor surface to the sheet. The copy sheet may be fed to the transfer station from a supply, a manual bypass path, or a duplex path to an area where it will contact the photoreceptor. To provide for an even transfer of toner material to the sheet, without undesirable dispersions or deletions caused by failure of toner to reach the copy sheets at the position corresponding to the original image, it is necessary that the copy sheet intimately contact the photoreceptor smoothly, without folds or wrinkles which, by causing surface variations in the copy sheet, cause transfer inconsistencies, and accordingly poor image quality.

To transfer the toner from the photoreceptor to the copy sheet, intimate contact between the two is required. However, during movement from the copy sheet supply through sheet feeding nip rolls and through a transfer station paper guide, or baffle arrangement to the contact position with the photoreceptor, the flimsy sheet tends to ripple, and there is a tendency for the side edges of the sheet, parallel to the direction of sheet travel, to contact the photoreceptor before the center portion of the sheet. As the photoreceptor is electrostatically charged, the sheet side edges tack to the photoreceptor somewhat tightly, and the sheet does not naturally smooth itself to form the required smooth intimate contact with the photoreceptor necessary for good image quality. In heavier, less flimsy paper weight sheets, the described problem is less noticeable as the heavier paper has a greater beam strength, which maintains the respective desired orientation of the edges and central portions of the sheets to allow appropriate contact. The problem of sheet non-smoothness is a particular problem with sheets returning from a duplex path having been subject to heating and extensive handling.

As the sheet leaves the transfer station baffle, there is a tendency of the trail edge of the sheet to flip away from the baffle due to a combination of factors including spring forces on the paper induced by the change in direction of the sheet as it moves away from the transfer baffle to contact with the photoreceptor, and the energy stored in the curled sheet releasing as it departs from the baffle. As a result of these forces on the paper, the trail edge of the sheet is caused to move suddenly towards the photoreceptor upon leaving the control of the transfer baffle. In this case, transfer of toner from the photoreceptor to the sheet is believed to occur before the trail edge of the sheet has made intimate contact with the photoreceptor, a phenomenon known as "gap transfer", causing a type of toner deletion known as "trail edge deletion".

U.S. Pat. No. 3,984,183 to Maksymiak suggests that increasing beam strength in a sheet improves post transfer stripping characteristics. Complementary curved photoreceptor and guide members accomplish this end by creating a curve extending in the sheet parallel to the direction of travel. The arrangement of curved guide members serves to provide a curve in the sheet matching a curve on the photoreceptor, whereby beam strength of sheets is increased. Increasing beam strength of sheets by applying a bow in a direction parallel to the path of paper travel is known in the printing arts as shown, for example, by U.S. Pat. Nos. 3,516,657 to Knudsen; 4,204,672 to Grivet; and 4,350,332 to Knight. These patents do not, however, teach applying a curvature to the sheet to induce a portion of the sheet to contact the photoreceptor prior to another portion.

U.S. Pat. No. 3,820,889 to Nitanda teaches a paper guide arrangement for avoiding certain deletion problems, including a pair of parallel spaced guide plates for directing transfer material to the photoreceptor. Either or both of the parallel guide plates are provided with a crowned edge in the plane of the guide plates.

SUMMARY OF THE INVENTION

It is a primary object of the present invention to improve the delivery of transfer materials such as copy sheets to the photoreceptor in a copying device.

It is another object of the invention to deliver sheets to the photoreceptor in a manner which advantageously prevents the early tacking of sheet edges to the photoreceptor.

It is yet another object of the invention to provide an arrangement which does not disadvantageously affect sheets not requiring photoreceptor contact control.

It is yet another object of the invention to provide an arrangement which prevents flipping trail edge deletions.

In accordance with the invention, an electrophotographic device having a transfer station for transferring developed toner images from a photoreceptor surface to transfer material such as a copy sheet, is provided with a baffle arrangement for directing sheets from a copy sheet supply to the area in which contact between the photoreceptor and the copy sheets is desired. The baffle arrangement is provided with upper and lower baffle members comprising elongated members supported transverse and parallel to the direction of sheet travel therepast. The lower baffle member is provided with a curved support surface portion extending into the path of paper travel to impart a curve to sheets passing thereby whereby a central portion of the sheets contacts the photoreceptor prior to the edge portions. Thus, the invention advantageously avoids the problems of early side edge tacking to the photoreceptor.

In accordance with another aspect of the invention, the upper baffle member is supported for free pivotal movement out of the plane of paper travel, and normally biased towards or against the lower baffle member to aid in imparting a curve corresponding to the curve on the lower baffle member to sheets passing thereby. When heavier weight sheets pass through the baffle arrangement, however, the upper pivoting baffle member is biased out of the path of paper travel reducing baffle drag on such sheets. The invention thereby avoids problems of baffle drag, which causes copy smearing on sheets which do not have the problem of early side edge tacking.

In accordance with yet another aspect of the invention, the upper baffle member is provided with a flexible lip extending transversely across the path of paper travel to contact sheets passing thereby. The flexible lip serves to release the trail edge of the sheet slowly thereby absorbing energy and reducing the spring forces in the sheet associated with flipping trail edge deletions.

These and other objects and advantages of the invention will become apparent as the following description is reviewed in conjunction with the accompanying drawings in which.

DESCRIPTION OF THE INVENTION

Figure 1:
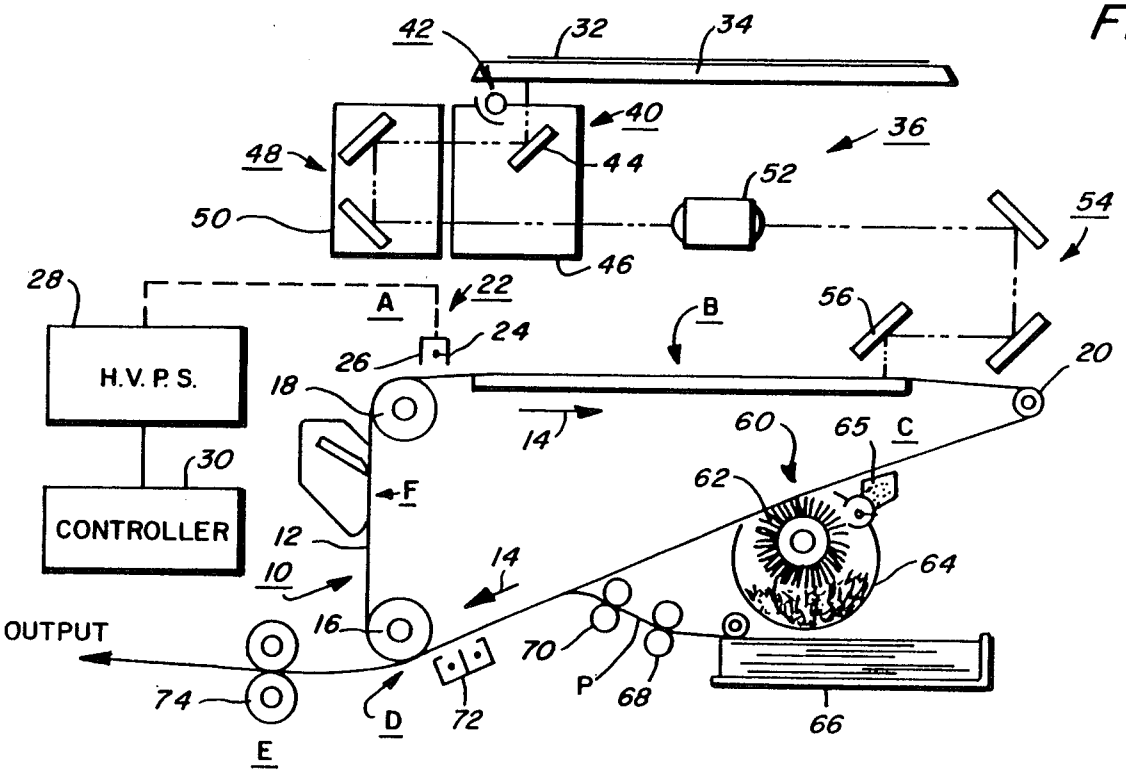
FIG. 1 is a schematic view of an xerographic reproduction machine of the type contemplated to embody the present invention.

Referring now to the drawings, wherein the showings are for the purpose of illustrating a preferred embodiment of the invention and not for the purpose of limiting same, FIG. 1 schematically depicts the various components of an illustrative electrophotographic device contemplated to incorporate the present invention therein. Inasmuch as the art of electrophotography is well known, the various processing stations employed in the FIG. 1 device will be shown hereinafter schematically and the operation described briefly with reference thereto.

As shown in FIG. 1, the electrophotographic device employs a belt 10 having a photoconductive surface 12 deposited on a conductive substrate. Belt 10 moves in the direction of arrow 14 to advance successive portions of photoconductive surface 12 sequentially through the various processing stations disposed about the path of movement thereof. Belt 10 is entrained around drive roller 16, and tension rollers 18 and 20. Drive roller 18 is mounted rotatably in engagement with belt 10 and driven by suitable means such as a conventional motor (not shown).

With continued reference to FIG. 1, initially a portion of belt 10 passes through charging station A. At charging station A, a corona generating device 22 charges photoconductive surface 12 of the belt 10 to a relatively high, substantially uniform potential. The corona generating device comprises charging electrode 24 and conductive shield 26. A high voltage power supply 28 controlled by controller 30 is connected to the charging electrode 24 to provide a high charging voltage and control the charge placed on the surface 12. Controller 30 is preferably a known programmable controller or combination of controllers, which conventionally controls all of the other machine steps and functions described herein and including the operation of document feeders, the paper path drives, and other machine operations. Controller 30 also conventionally provides for storage and comparisons of counted values including copy sheets and documents, and numbers of desired copies, and control of operations selected by an operator.

Next, the charged portion of photoconductive surface 12 is advanced through exposure station B. At exposed station B, an original document 32 is positioned face down upon transparent platen 34. Optics assembly 36 contains optical components which incrementally scan and illuminate original document 32 and project a reflected image on surface 12 of belt 10. Shown schematically, these optical components comprise an illumination scan assembly 40, comprising illumination lamp and reflector 42, and full rate scan mirror 44 mounted on scan carriage 46. The carriage is supported for reciprocating movement in accordance with copying requirements along rails (not shown) extending parallel and below the length of the platen 34. Light reflected from the image is reflected by full rate scan mirror 44 to corner mirror assembly 48 on half rate scan carriage 50, which follows full rate carriage 44 at half the speed of the full rate carriage. The reflected light image from corner mirror assembly 48 is directed through lens 52, to a second corner mirror arrangement 54, and projected therefrom onto the charged portion of photoconductive surface 12 by mirror 56 to selectively dissipate the charge on the photoconductive surface. This records an electrostatic latent image on photoconductive surface 12 which corresponds to the information areas contained within original document 32. It will, of course, be appreciated that a similar function is accomplished by an electronic printer employing a laser to selectively dissipate charge from a photoconductive surface.

Thereafter, belt 10 advances the electrostatic latent image recorded on photoconductive surface 12 to development station C. At development station C, a magnetic brush development system 60, including a magnetic brush developer roller 62 within housing 64 advances a developer mix of toner particles and carrier granules into contact with the electrostatic latent image. The latent image attracts the toner particles from the carrier granules forming a toner powder image on photoconductive surface 12 of belt 10. Additional toner is stored for use upon demand in toner particle dispenser 65.

Belt 10 then advances the toner powder image on surface 12 to transfer station D. A substrate, which may include paper sheets, transparencies, computer fan fold stacks, rolls of paper stock, etc., and hereinafter referred to as a sheet P is advanced toward transfer station D by a pair of feed roll pairs 68 and 70 in a timed sequence by a suitable conventional feeding arrangement so that the toner powder image developed on the photoconductor surface synchronously contacts the advancing sheet P at transfer station D.

Transfer station D includes a corona generating device 72 which sprays ions onto the back side of sheet P passing through the station. The toner powder image from the photoconductive surface 12 is thereby attracted to the sheet, and a normal force is provided which causes photoconductive surface 12 to take over transport of the advancing sheet P. After transfer, the sheet continues to move advancing to fusing station E.

Fusing station E includes a fuser assembly, indicated generally by the reference number 74, where a sheet is stripped from the photoreceptor surface and passed through a heated nip roll pair whereby the toner powder image is permanently affixed to the sheet. After fusing, the advancing sheet is directed to an output for removal from the printing machine by the operator. Alternatively the sheets may be directed to a finishing module where further paper handling functions, such as stapling, stacking, collating, etc., are available.

Invariably, after the sheet support material is separated from the photoconductive surface 12 of belt 10, some residual particles remain adhering thereto. These residual particles are removed from photoconductive surface 12 at cleaning station F.

Figure 2:
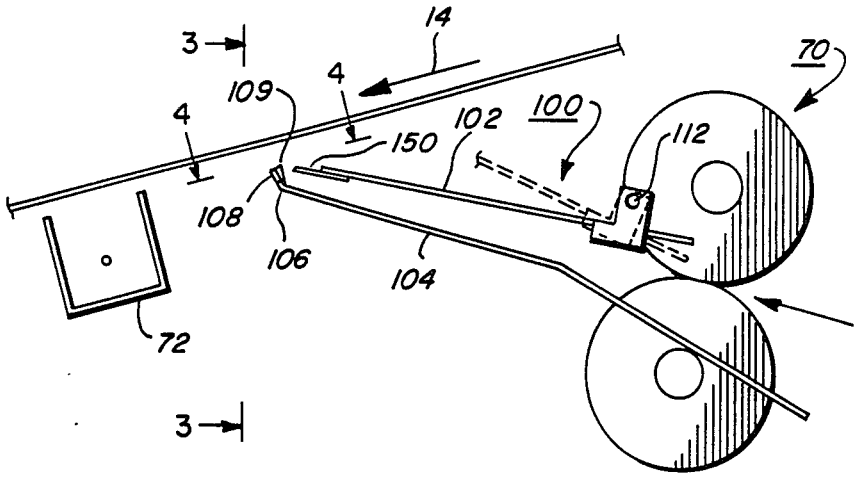
FIG. 2 is a cross sectional view of a portion of a transfer station in accordance with one embodiment of the invention.
Figure 3:
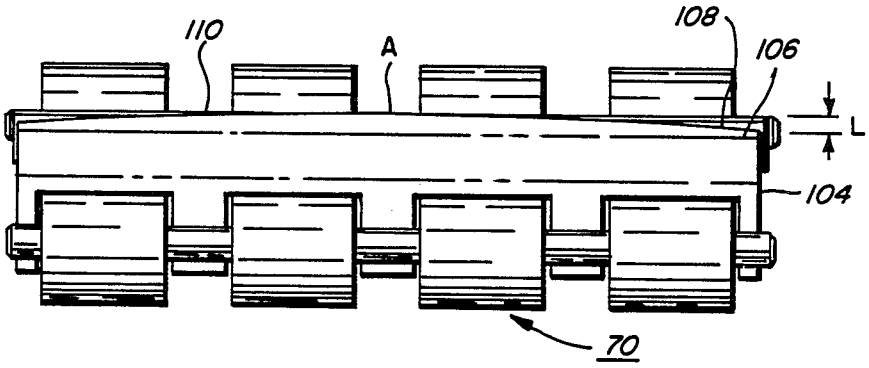
FIG. 3 is a view along the section 3—3 of FIG. 2, showing the lower baffle member of the transfer baffle arrangement.

In accordance with the invention, and referring more particularly to FIG. 2, transfer material such as paper sheets are fed from a supply such as sheet tray, a duplex path or a manual sheet bypass path toward the photoreceptor and transfer station D through nip roll pair 70. On passing nip roll pair 70, sheets are directed through a baffle arrangement 100 comprising upper and lower baffle members 102 and 104 respectively, which, in combination, direct sheets into contact with photoconductive surface 12. Lower baffle 104 may be an elongated member extending transversely across and generally parallel to the path of sheet travel providing a sheet support surface, generally parallel to the path of sheet travel therepast. As shown in FIGS. 2 and 3, lower baffle 104 may be provided with a flanged lip 106 having a crowned edge 108. Crowned edge 108 may be provided with an arcuate or chevroned edge in the flanged lip 106 similar to that provided in U.S. Pat. No. 3,820,889. The edge of flanged lip 106 extends convexly towards the photoreceptor in the plane of the flanged lip and having an apex or outermost extending point A of the arc or chevron along the center of the path of paper travel. The arcuate or chevroned edge may range a distance L about 0.25 to 0.5 mm from the horizontal at the apex point.

Figure 4:
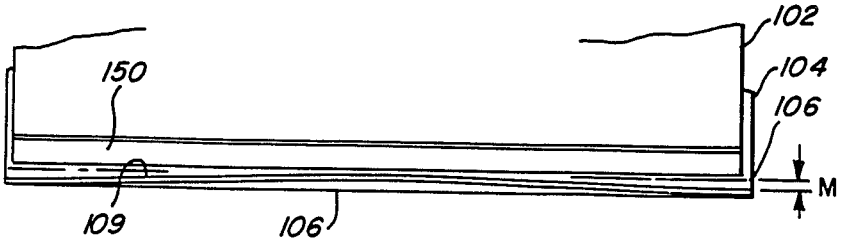
FIG. 4 is a view along the section 4—4 of FIG. 2 of the lower baffle member.

In accordance with the invention, and as best seen in FIGS. 2 and 4, flanged lip 106 is also provided with a bowed surface 109 forming a bowed paper supporting surface transverse to the direction of paper travel, and extending convexly outwardly from flanged lip 106 towards the photoreceptor surface, which will contact sheets passing thereby. In a preferred embodiment bowed surface 109 is generally an arcuate surface having an outermost extending point along the center of the path of paper travel, although it is well within the scope of the invention to provide two planar surfaces intersecting at an apex to form a slight angle. The bowed surface may range a distance M of approximately 0.25 to 0.5 mm from a plane defined by the flanged lip 106. In a preferred embodiment, the flanged lip 106 is a single sheet metal member which is stamped or blanked to form crown 108, and subsequently bowed to form the bowed surface 109. The formed member is then fixed to the lower baffle member to form an integral member.

Sheets passing lip 106 are directed toward the photoreceptor surface, and provided with a bend corresponding to bowed surface 109 through a central portion of the sheet along a line parallel to the direction of sheet travel. The bow or curve thereby imparted to the sheets has the tendency to place the central portions of the sheet along a line parallel to the path of travel of the sheet, into contact with the photoreceptor prior to the side edges parallel to the path of travel. The sheet side edges come into contact with the photoreceptor at a later time, and the intimate contact required between the sheet and the photoreceptor is achieved with the central portion of the sheet tacked to the photoreceptor first, and the edges tending to naturally follow the central portion into proper contact positions. It will no doubt be appreciated that other non-planar shapes of paper or substrate supporting surfaces may be provided within the scope of the invention, which force the central portion of the sheet passing thereby into contact with the photoreceptor prior to the side edges.

Referring again to FIG. 2, upper baffle member 102 is arranged generally parallel to the lower baffle, transverse to the path of sheet travel. Upper baffle member 102 is supported at an end close to the nip roll pair 70 for free pivoting motion about an axis 112, also arranged transverse to the path of sheet travel and parallel to lower baffle 104. Upper baffle 102 is naturally biased by its own weight to a position towards or against lower baffle 104. The weight of upper baffle 102 serves to aid in imparting a bow corresponding to the curvature of curved surface 109 to sheets passing thereby by biasing sheets against flanged portion 106 and the curved sheet supporting surface 109 as the sheets pass between the two baffle members 102 and 104.

In accordance with another aspect of the invention, pivoting upper baffle member 102 is pivotally moved out of its biasing relationship with lower baffle member 104 on the passage of heavier sheets of paper therebetween as shown in phantom in FIG. 2. Sheets of paper having paper weight of about 32 lbs. bond or greater have a naturally greater beam strength associated with the heavier weight, and a baffle arrangement has a tendency to create a drag on such sheets causing smearing in the contact with the photoreceptor. The pivotal movement of the upper baffle out of biasing engagement with the lower baffle has the effect of reducing this drag. Accordingly, the weight and size of baffle member 104 are selected to provide a biasing force on the baffle member to allow pivoting movement upon the passage of heavy weight sheets thereby. Other biasing arrangements such as spring bias or counter weight bias are well within the scope of the invention.

In accordance with yet another aspect of the invention, as best seen in FIGS. 2 and 4, upper baffle member 102 is provided with a flexible lip or edge member 150 extending along the edge of the baffle member closest to the photoreceptor transverse to the path of paper travel, and having a free end extending in the direction of copy sheet travel through the baffle arrangement. Flexible edge member 150 may be of a thin plastic material such as polycarbonate, about 0.1 mm thick, and extending about 5 mm from the edge of the upper baffle member 102 closest to the photoreceptor. The flexible edge member 150 is supported to be flexible in the direction of the photoreceptor with the force of paper upon it.

Sheets traveling through the baffle arrangement 100 and over flange 106 change direction of travel by an angle of between 45° and 85° as sheets contact surface 12 of the photoreceptor. Associated with this significant change of direction is a spring force which causes the trailing edge of the sheet to flip suddenly away from engagement with baffle member 102, and into contact with the photoreceptor upon leaving the rigid arrangement 100 causing degradation of the latent toner image on the photoreceptor surface 12. Accordingly, the flexible member 150 has the effect of reducing and slowing the flipping movement by allowing the spring force of the sheets to exert some of the stored energy against the flexible member 150. In this manner, the distance associated with the flip of the trail edges from the baffle to the photoreceptor surface is somewhat reduced, and image degradation caused by this factor is lessened.

While the invention has been described with reference to the structure disclosed, it is not confined to the details set forth or the embodiment described. The invention may find advantageous use with other printing processes requiring smooth intimate contact between a substrate and an image bearing surface, and is intended to cover such modifications or changes as may come within the scope of the following claims.

We claim:

1. Electrophotographic apparatus, wherein a developed image is transferred from an imaging surface to a substrate placed in intimate contact therewith at a transfer station, and including a baffle arrangement extending from a substrate supply towards the transfer station directing the substrate from the substrate supply towards the imaging surface, said baffle arrangement comprising a first baffle member, said first baffle member provided with a non-planar substrate supporting surface extending at a central portion towards the imaging surface for imparting a bow to the substrate passing therealong, along a line parallel to the direction of movement of the substrate, whereby a central portion of said substrate contacts with the imaging surface prior to edge portions of the substrate;

a second baffle member, arranged generally closely spaced from said first baffle member, supported for free pivotal movement away from said first baffle member, and biased generally towards said first baffle member, whereby the substrate is biased by said second baffle member against said non-planar substrate supporting surface, and substrates having heavier weight bias the second baffle member away from said first baffle member to avoid imparting a bow to said heavier weight substrates.

2. The apparatus of claim 1 wherein said non-planar substrate supporting surface is a generally curved surface.

3. The apparatus of claim 1, wherein the bow imparted to the substrate by the non-planar substrate supporting surface extends in the range of 0.25 to 0.5 mm from horizontal.

4. The apparatus of claim 2, wherein the bow imparted to the substrate by the curved surface extends in the range of 0.25 to 0.5 mm from horizontal.

5. The apparatus of claim 1 wherein said second baffle member is adapted to be biased away from said first baffle member by substrates having a heavier weight, whereby drag on said substrates is minimized.

6. The apparatus of claim 1 wherein said second baffle member is biased towards said first baffle member by the weight of said second baffle member.

7. Electrophotographic apparatus, wherein a developed image is transferred from a photoreceptor surface to a copy sheet which is placed in intimate contact with the photoreceptor surface at a transfer station, and including a baffle arrangement extending from a copy sheet supply towards the transfer station carrying copy sheets from said copy sheet supply to said photoreceptor surface, said baffle arrangement comprising:

a first lower baffle member fixedly supported with respect to said photoreceptor surface, and extending transversely across and parallel to the path of copy sheet movement from said copy sheet supply towards said transfer station, and provided with a lip portion arranged closely adjacent to said photoreceptor surface, and transverse and parallel to the path of copy sheet movement to said photoreceptor surface, said lip portion further comprising a bowed sheet supporting surface extending towards said photoreceptor surface, most closely adjacent thereto at a midpoint, whereby a central portion of said copy sheets passing thereby is urged into contact with said photoreceptor surface prior to edge portions of said copy sheets; and a second upper baffle member arranged generally closely spaced to said first lower baffle member, between said photoreceptor surface and said first lower baffle member, supported for free pivotal movement in a direction away from said first baffle member; and biased generally towards said first baffle member, whereby copy sheets moving therepast are biased by said second upper baffle member against said bowed surface, and copy sheets having heavier weight bias the second baffle member away from said first baffle member to avoid imparting a bow to said heavier weight copy sheets.

8. The apparatus of claim 7 wherein said bowed paper supporting surface provides a curve extending in the range of about 0.25 to 0.5 mm from the horizontal.

9. The apparatus of claim 7 wherein said second upper baffle member is adapted to be biased away from said first lower baffle member by copy sheets having a heavier weight, whereby drag on said copy sheets is minimized.

10. The apparatus of claim 9 wherein said second baffle member is biased towards said first baffle member by the weight of said second baffle member.

11. Electrophotographic apparatus, wherein a developed toner image is transferred from a imaging surface to a copy sheet placed in intimate contact with the imaging surface at a transfer station, and including a copy sheet guide means extending from a copy sheet supply means towards the transfer station, carrying copy sheets from said copy sheet supply means to said imaging surface, said copy sheet guide means comprising:

a first baffle member fixedly supported with respect to said imaging surface, and extending transversely across and parallel to the path of copy sheet movement from said copy sheet supply means towards said transfer station, and provided with flanged portion arranged on a said baffle member closely adjacent to said imaging surface, transverse and parallel to the path of copy sheet movement to said imaging surface, said flanged portion including an arcuate paper supporting surface, having a central portion extending towards said imaging surface, whereby said central portion of said copy sheets passing thereby is urged into contact with said imaging surface prior to edge portions of said copy sheets; and a second baffle member, arranged generally closely spaced from said first baffle member, between said imaging surface and said first baffle member, supported for pivotal movement in a direction away from said first baffle member, and biased generally towards said first baffle member, whereby copy sheets moving therepast are biased by said second baffle member against said arcuate surface.

12. Electrophotographic apparatus, wherein a developed toner image is transferred from a photosensitive surface to a copy sheet placed in intimate contact with the photosensitive surface at a transfer station, and including a copy sheet guide means extending from a copy sheet supply means towards the transfer station, carrying copy sheets from said copy sheet supply means to said photosensitive surface, said copy sheet guide means comprising:

a first baffle member fixedly supported with respect to said photosensitive surface, and extending transversely across and parallel to the path of copy sheet movement from said copy sheet supply means towards said transfer station, and provided with flanged portion arranged on a said member closely adjacent to said photosensitive surface, transverse and parallel to the path of copy sheet movement to said photosensitive surface, said flanged portion including an arcuate paper supporting surface, having a central portion extending towards said photosensitive surface, whereby said central portion of said copy sheets passing thereby is urged into contact with said photosensitive surface prior to edge portions of said copy sheets;

a second baffle member, arranged generally closely spaced to said first baffle member, between said photosensitive surface and said first baffle member, supported for pivotal movement in a direction away from said first baffle member, and biased generally towards said first baffle member, whereby copy sheets moving therepast are biased by said second upper baffle member against said curved surface; and a flexible edge member along an edge of said second baffle member, closely adjacent to the photosensitive, and extending in the direction of copy sheet movement through the sheet guide means, said flexible edge member flexing towards said photosensitive surface on contact with a trail edge of the copy sheets passing thereby.

* * * * *